US007231716B2

(12) United States Patent
Verilli

(10) Patent No.: US 7,231,716 B2
(45) Date of Patent: Jun. 19, 2007

(54) METHOD OF MAKING A THIN WALL NOZZLE

(76) Inventor: Brian L. Verilli, 7407 Brava St., Carslbad, CA (US) 92009

( * ) Notice: Subject to any disclaimer, the term of this patent is extended or adjusted under 35 U.S.C. 154(b) by 913 days.

(21) Appl. No.: 10/319,906

(22) Filed: Dec. 16, 2002

(65) Prior Publication Data

US 2003/0071149 A1 Apr. 17, 2003

Related U.S. Application Data

(62) Division of application No. 09/828,621, filed on Apr. 6, 2001, now abandoned.

(51) Int. Cl.
*B21K 21/08* (2006.01)
*B21D 22/00* (2006.01)

(52) U.S. Cl. ..... 29/890.142; 29/890.14; 29/890.12; 29/890.132; 72/356

(58) Field of Classification Search ..... 29/890.14, 29/890.12, 890.132, 890.142; 72/356; 239/589, 239/591, 600, 601; 222/567, 570
See application file for complete search history.

(56) References Cited

U.S. PATENT DOCUMENTS 3,419,220 A * 12/1968 Goodwin et al. ..... 239/591
3,681,960 A * 8/1972 Tadokoro ..... 72/61
4,161,280 A * 7/1979 Kasinskas ..... 239/1
4,421,722 A * 12/1983 Massey et al. ..... 422/129
5,104,013 A * 4/1992 Hawley ..... 222/566
5,109,823 A * 5/1992 Yokoyama et al. ..... 123/472
6,131,282 A * 10/2000 Takami et al. ..... 29/890.12
6,186,422 B1 * 2/2001 Hubner et al. ..... 239/589
2001/0022024 A1 * 9/2001 Takeuchi et al. ..... 29/890.142

* cited by examiner

*Primary Examiner*—David P. Bryant
*Assistant Examiner*—Sarang Afzali

(57) ABSTRACT

A novel method of making a nozzle by forcing a malleable metallic disk into a series of cavities in progression using punches to draw down a formed section so metal can be pulled into the shape of the next cavity in the series. Each cavity differs in size and shape, progression of the nozzle to the next cavity occurs until the metal is incrementally hardened by each step in the progression and the desired shape is formed. Wall thickness of the nozzle can be selectively varied in each section drawn down or pulled. Exceptionally accurate nozzles can be made with smooth, hard, rigid, walls of varying and constant thickness at low cost.

1 Claim, 3 Drawing Sheets

METHOD OF MAKING A THIN WALL NOZZLE

CROSS REFERENCE TO RELATED APPLICATIONS

This is a Division of application Ser. No. 09/828,621, Filed Apr. 6, 2001, now abandoned.

FEDERALLY FUNDED RESEARCH

Not Applicable

SEQUENCE LISTING OR PROGRAM

Not Applicable

BACKGROUND OF INVENTION

1. Field of the Invention

This invention pertains to the field of liquid dispensing equipment. More particularly, it pertains to a method of making a novel nozzle that is applicable to manufacture of nozzles with constant or varying wall thickness. The technique will produce metallic nozzles with very thin rigid walls from metals that have a tendency to become hard and rigid when worked into final shape.

2. Description of the Prior Art

Nozzles made for dispensing of viscous fluids are produced in a variety of different ways. The method and material selected are a function of the general category.

At present there are three general types of nozzles used to underfill electronic devices with viscous liquid: (1) a modified hypodermic needle made of stainless steel and medical tubing, (2) a custom machined metal nozzle, and (3) a molded plastic cone-shaped nozzle. The modified hypodermic needle nozzle is merely a standard hypodermic needle adapted to fit to a standard valve (Luer or Luer lock type) and attached to a hose leading from a pump that is connected to a reservoir of liquid. Modified hypodermic needles have a constant diameter throughout the length. This causes a very high-pressure drop across the needle and restricts liquid flow. In addition, the needle is made from stainless steel, plastic, or brass. Stainless steel and plastic are not known as good heat transfer materials. The fluid path is not contiguous and usually constrictive at the connection point. Transition points of the flow channel through the nozzle using this manufacturing technique are abrupt and inconsistent. The custom machined nozzle may be made of better heat transfer materials and may be shaped to remove or, at least, greatly reduce the resistance produced in the hypodermic needle design. However, a machined nozzle is limited to the size of the tools that can be used to cut the inside wall diameter and the wall thickness that must be maintained to ensure cuts are made without deformation of the nozzle. Machining of nozzles can be applied to one and two-piece designs, any shape can be made that can be programmed to cut using computer controlled lathes or form tools ground for the purpose. It is difficult to make very small gage sizes, almost impossible if the nozzle wall is thin. These limitations, along with the high cost of machining minute nozzles of this type, have slowed the widespread use of such nozzles in the industry.

The molded plastic nozzle is the lowest cost nozzle produced, it can be made in a variety of sizes and shapes out of a number of engineering polymers using plastic injection molding. However, plastics are not good agents of heat transfer, they are not dimensionally stable, require a relatively loose tolerance, expand and contract when exposed to high intermittent pressures and have threads that have little resistance to failure by over tightening. Such a practice has not been well accepted in the industry. The modified hypodermic needle remains the most widely used nozzle.

3. Objects and Advantages

Accordingly, the method of making the nozzle has inherent objects and advantages that were not described earlier in my patent. Several additional objects and advantages of the present invention are:

(1.) To provide a method of producing a nozzle wherein Process enables a constant thickness wall at the core inlet, selectively thinning the core wall between various sections to achieve a wall thin enough to allow a punch to pierce the section without fracture. Through experimentation it has been found the equation $$PcPf=12.0535-0.268653*Gage-1445.17*Wall$$

will yield suitable results for prediction of Carbide punch failure for a given section composed of copper alloy, apriori. Simplified empirical equation fit from data using Ridge Regression Techniques is accurate within a range of 0.001 in to 0.005 in. in wall thickness. Values of Pc/Pf; the Critical Punch Force/Force To Punch The Hole approaching Pc/Pf<=1, indicate punch fracture from the force required to pierce thru the nozzle wall.

(2.) To provide a method of producing a conically shaped exit aperture; radial clearance between punch and die can be adjusted to vary the conical depth through the exit aperture wall.

(3.) To provide a method of producing a nozzle wherein the thinness of the nozzle wall is such that geometry for features, rifling or striations or other like details can be built into the outside wall of the die cavity. Metal forced against the die side bends inward to produce a raised image of the geometry on the inside of the nozzle cavity.

(4.) To provide a method of producing a nozzle wherein soft, ductile, thermally efficient, conductive metals can be cold worked to the extent the metal effectively hardens and becomes rigid. Copper and copper alloys are the best candidates for the process.

(5.) To provide a method of producing a nozzle wherein Process is fast and low cost to proliferate the use of the technology in the industry.

(6.) To provide a method of producing a nozzle wherein very low Nozzle-to-Nozzle variability is a result of exceptionally tight tooling tolerances enabled by the process. Nozzle bore tolerance is routinely held to ten thousandths of an inch.

(7.) The high aspect ratio of the process produces a nozzle core that is composed of one piece or contiguous.

(8.) The Process can produce compound bend radii as tight as 0.0014 inch on a 0.0014-inch thick wall with copper alloys. The ratio wall thickness/bend radii can be as large as 1.0 using this material in the annealed or softened condition.

Thinner walls also provide less facial area at the base upon which liquid can adhere resulting in a cleaner break-off of the dispensed liquid. The thinner wall also results in the smallest difference between the surface areas on the exterior, as opposed to the interior. This provides less surface tension forces, which direct the fluid to accumulate on the exterior of the nozzle. Thus more liquid is held on the interior of the nozzle improving both speed and accuracy of dispensing and of the automated dispensing equipment upon which it may be used. Additionally, the material making up the nozzle must have good heat transfer characteristics. This enables reduction of viscosity in most liquids, thereby enhancing the dispensability of the liquid. Further, the thinner wall also enables a more uniform and rapid thermal response to the entire nozzle body. Finally, thinner walls enable dispensing on densely populated circuitry, effectively depositing fluid closer to the chip.

SUMMARY OF THE INVENTION

The invention is a novel method of making such a nozzle N for delivering a measured quantity of viscous liquid into minute spaces comprising the steps of placing a small circular tablet T of a thermally conductive, malleable metal on a circular die Dx having a cylindrically extended inner wall Wx, advancing a conically-shaped mandrel Mx against the center of the tablet T and forcing the metal to be drawn down into the die Dx and along the cylindrically extending inner wall Wx, and repeating these steps using progressively smaller-diameter, conically-shaped mandrels My and Mz and progressively smaller diameter, circular dies Dy and Dz, each having cylindrically extending inner walls Wy and Wz, until a thin-walled nozzle N is formed comprising an upper flared opening 3 defined by a horizontal perimeter 5 and a flare wall F extending horizontally inward from the perimeter 5, a cylindrically-shaped barrel wall 11 extending from the flare wall F downward to a break point 13 defined by a circle parallel to the flare opening 3 and spaced-apart therefrom, a cone-shaped wall 15 extending downward from the circular break point 13 and inward there from to a circular exit opening 17, and a small-diameter exit tube 25 extending from a circular exit opening 17, at one end of the tube 27, to a circular exit aperture 31, located at the other end of the tube 29, or a cone-shaped wall 15 extending downward from the circular break point 13 and inward there from to a circular exit aperture 31. A nozzle N with a thin wall able to dispense liquid close to the device; and, a nozzle N made with a low cost process that allows the nozzles N to be made more economically and more useful in the relevant industry.

These and other objects of the invention will become clearer when one reads the following specification, taken together with the drawings that are attached hereto. The scope of protection sought by the inventor may be gleaned from a fair reading of the claims that conclude this specification.

DESCRIPTION OF THE DRAWINGS—FIGURES

Turning now to the drawings wherein elements are identified by numbers and like elements are identified by like numbers throughout the three figures, the inventive method of manufacture of a nozzle is depicted in FIGS. 1-3.

DESCRIPTION OF THE PREFERRED EMBODIMENT

Figure 1:
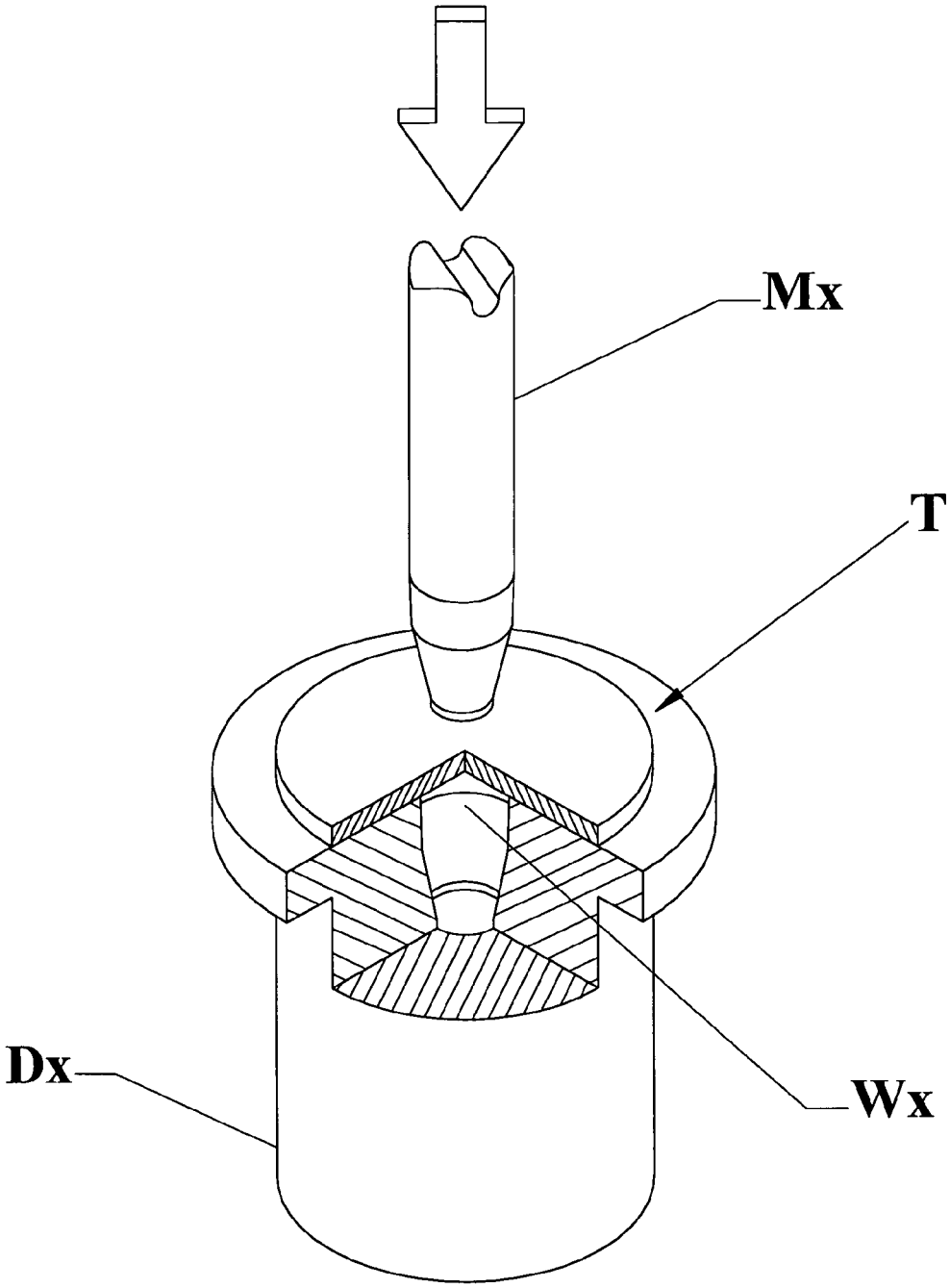
FIG. 1 is an illustrative view of the first step in the process of making the nozzle of this invention.
Figure 2:
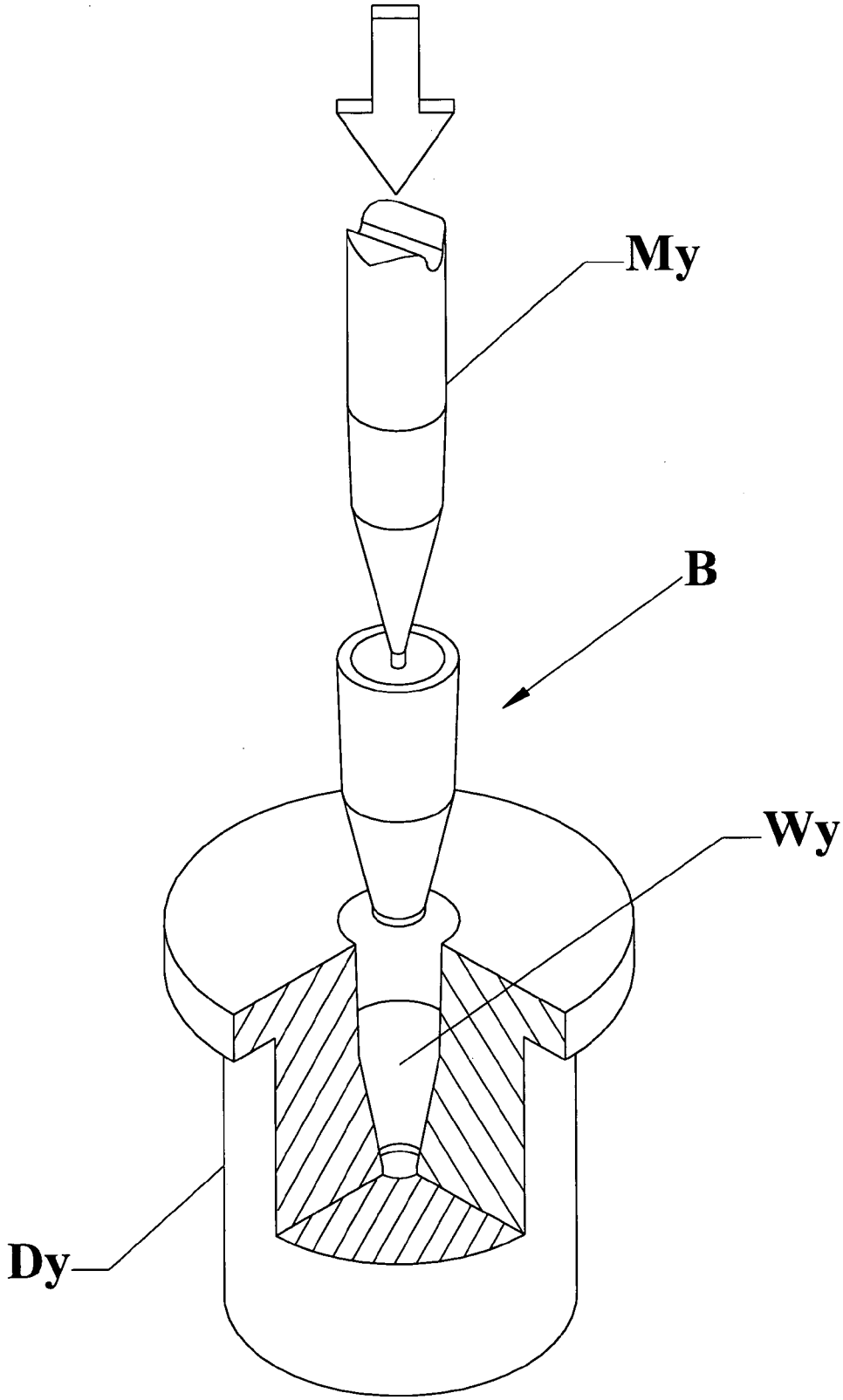
FIG. 2 is an illustrative view of the second and later steps in the process.
Figure 3:
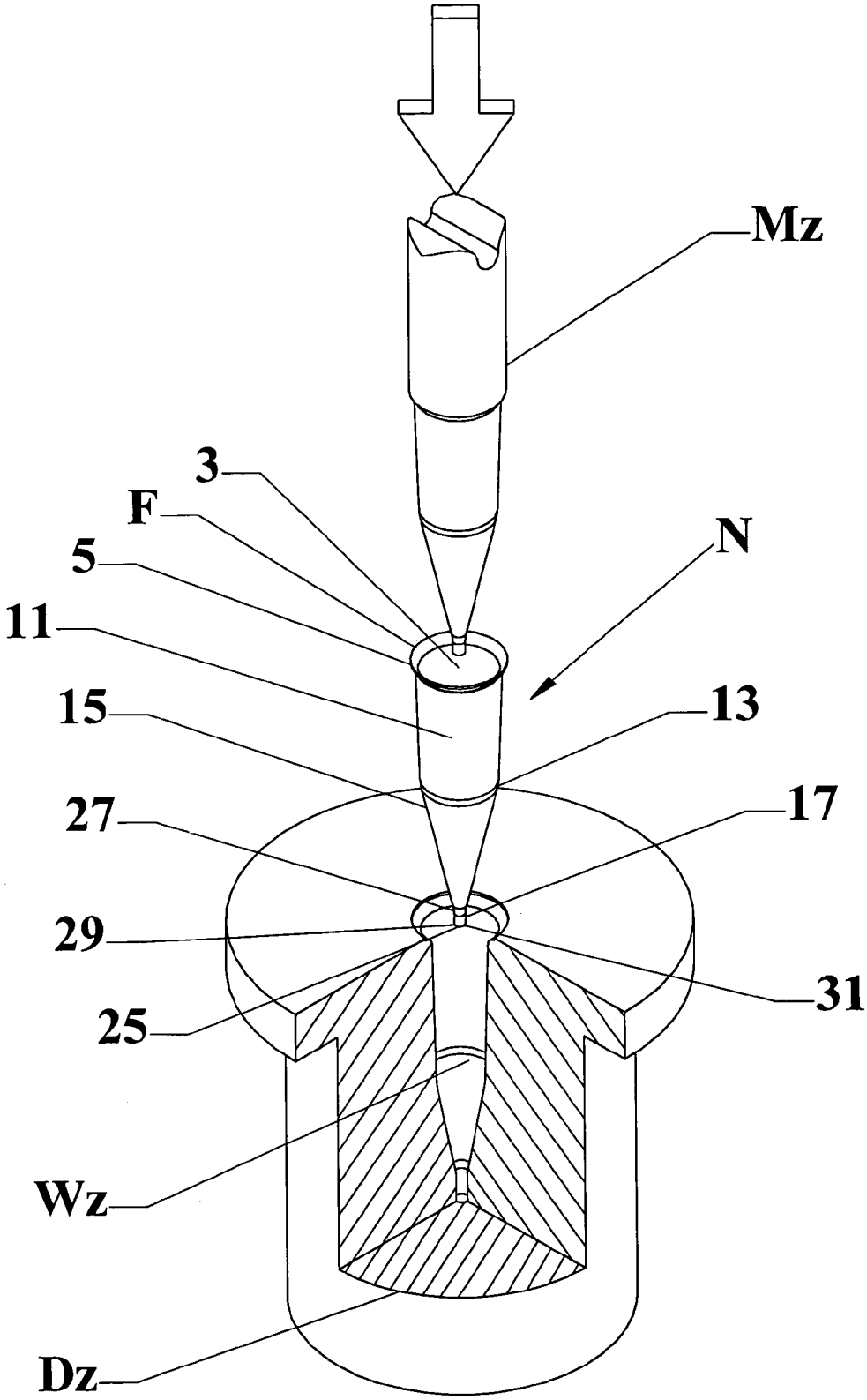
FIG. 3 is an illustrative view of the last step in the process shown in FIGS. 1 and 2.

The invention is a novel method of making a nozzle N by the deep drawing process. It is preferred that the nozzle N be made in one, monolithic unit so that the possibility of crevices, which could trap air or restrict flow, is eliminated and that assembly is kept to a minimum. A flared wall F locates the core in relation to the Lure threaded hub for both reusable mechanical hub and brazed hub connection assemblies. Such a method is shown in FIGS. 1-3 and shows the steps of placing a small circular tablet T (FIG. 1), of a malleable, thermally conductive material, containing a high percentage of copper, on a circular die Dx having a cylindrical extended inner wall Wx. An elongated, conically-shaped mandrel Mx is brought against the center of tablet T and forced against the metal thereby drawing it down into die Dx and along cylindrical extended inner wall Wx to form a blank B. Mandrel Mx is then removed and the deformed tablet T is removed from die Dx. These two steps are then repeated, as shown in FIGS. 2 and 3, using progressively smaller-diameter, conically-shaped mandrels My and Mz and progressively smaller-diameter circular dies Dy and Dz having deeper and narrower cylindrical extended inner walls Wy and Wz until the finished nozzle N is formed. The nozzle is then trimmed at each end, mandrel Mz shears an opening for said exit aperture 31, radial offset between mandrel Mz and die Dz trims the inner wall Wz in a conical fashion across the thickness, And, or, flared wall F formed by a press or other such device as is known in the prior art.

While the invention has been described with reference to a particular embodiment thereof, those skilled in the art will be able to make various modifications to the described embodiment of the invention without departing from the true spirit and scope thereof. It is intended that all combinations of elements and steps, which perform substantially the same function in substantially the same way to achieve substantially the same result, be within the scope of this invention.

What is claimed is:

1. A method of making a nozzle for delivering a measured quantity of viscous liquid into minute spaces comprising the steps of:

a) Placing a small circular tablet of a malleable metal, containing a majority of copper, on a circular die having a cylindrical extended inner wall;

b) Advancing a conically shaped mandrel against said tablet and forcing the metal to be drawn down into said die and along said cylindrical extended inner wall;

c) Repeating steps a) and b) using progressively smaller-diameter, conically shaped mandrels and progressively smaller diameter circular dies having cylindrical extended inner walls until a nozzle is formed comprising:

d) A flared opening defined by a horizontal perimeter and a flare extending inward from said perimeter;

e) A cylindrically shaped barrel wall extending from said flare wall downward to a break point defined by a circle parallel to said flare opening and spaced apart therefrom;

f) A cone shaped wall extending downward from said circular breakpoint and inward therefrom to a circular exit aperture; or;

g) A cone shaped wall extending downward from said circular breakpoint and inward therefrom to a circular exit opening; and, a small-diameter exit tube extending from said circular exit opening to a circular exit aperture.

* * * * *